US005359930A

United States Patent [19]

Hansen

[11] Patent Number: 5,359,930

[45] Date of Patent: Nov. 1, 1994

[54] DEVICE FOR ALIGNING FLIES FOR A PRINTING PRESS

[75] Inventor: Robert E. Hansen, Clarendon Hills, Ill.

[73] Assignee: Rockwell International Corporation, El Segundo, Calif.

[21] Appl. No.: 123,014

[22] Filed: Sep. 17, 1993

[51] Int. Cl.[5] ..... B41F 13/24; B65H 29/20

[52] U.S. Cl. ..... 101/232; 271/187; 271/315

[58] Field of Search ..... 701/232, 216; 271/900, 271/315, 83, 187

[56] References Cited

U.S. PATENT DOCUMENTS

| | | | |
|---|---|---|---|
| 4,925,179 | 5/1990 | Breton et al. | 271/187 |
| 5,083,998 | 1/1992 | Carter | 271/187 |
| 5,120,049 | 6/1992 | Fischer | 271/315 |
| 5,123,638 | 6/1992 | Mutou | 271/315 |
| 5,131,646 | 7/1992 | Balow | 271/187 |
| 5,156,389 | 10/1992 | Novick | 271/315 |
| 5,236,188 | 8/1993 | Breton et al. | 101/232 |

FOREIGN PATENT DOCUMENTS

| | | | |
|---|---|---|---|
| 0527317 | 2/1993 | European Pat. Off. | 271/315 |

*Primary Examiner*—Eugene H. Eickholt
*Attorney, Agent, or Firm*—C. B. Patti; H. F. Hamann

[57] ABSTRACT

A device for delivering signatures (S) for a printing press (10) having a delivery device (50) having a plurality of sets (60*a* and 60*b*) of flies (58*a*, 58*b*, 58*c*, and 58*d*), with the flies (58*a–d*) each having a plurality of open pockets (26) disposed around the flies (58*a–d*), a device (62*a* and 62*b*) for stripping signatures (S) from the pockets (26) disposed between a pair of adjacent flies (58*a* and *b*, and 58*c* and *d*) in each set (60*a* and *b*) of the flies (58*a–d*), a device (76, 78, and 80) for adjusting the sets (60*a* and *b*) of flies (58*a–d*) and stripping devices (62*a* and *b*) in unison laterally across the delivery device (50), and a device (64 and 84) for modifying the lateral distance between adjacent sets (60*a* and *b*) of the flies (58*a–d*) and respective stripping devices (62*a* and *b*).

9 Claims, 4 Drawing Sheets

DEVICE FOR ALIGNING FLIES FOR A PRINTING PRESS

CROSS-REFERENCE TO RELATED APPLICATION

The present application is related to application Ser. No. 111,743, filed Aug. 25, 1993.

BACKGROUND OF THE INVENTION

The present invention relates to devices for aligning flies in a printing press.

In the past, rotary flies having open pockets disposed around the flies have been utilized in printing presses to deliver signatures from a folder in a shingled configuration onto a conveyor belt. During this time, a leading edge of the signatures must be stripped from the pockets of the fly onto the conveyor belt, such as by fixed stripping devices. However, such signatures delivered from the folder may have varying widths, or may be passed to the flies at different lateral locations. Hence, it is necessary to adjust the flies in order to accommodate such varying incoming signatures.

SUMMARY OF THE INVENTION

A principal feature of the present invention is the provision of an improved device for aligning flies in a printing press.

The device of the present invention comprises, a delivery device having a plurality of sets of flies, with the flies having a plurality of open pockets disposed around re flies, and means for stripping signatures from the pockets disposed between a pair of adjacent flies in each set of the flies.

A feature of the invention is the provision of means for laterally modifying the distance between different sets of flies and associated stripping means in each of the sets.

Thus, a feature of the invention is that different sets of flies may be adjusted in order to accommodate signatures of differing widths.

Another feature of the invention is the provision of means for laterally adjusting all the sets of flies in unison across the delivery device.

Thus, a feature of the invention is that the flies may be adjusted to accommodate different lateral locations for the signatures.

A further feature of the invention is that the flies may be adjusted in a simple manner.

Yet another feature of the invention is that the flies may thus be adjusted in order to both accommodate signatures of varying widths, and also signatures passing to the flies at differing lateral locations across the deliver device.

Further features will become more fully apparent in the following description of the embodiments of this invention and from the appended claims.

DESCRIPTION OF THE PREFERRED EMBODIMENTS

Figure 1:
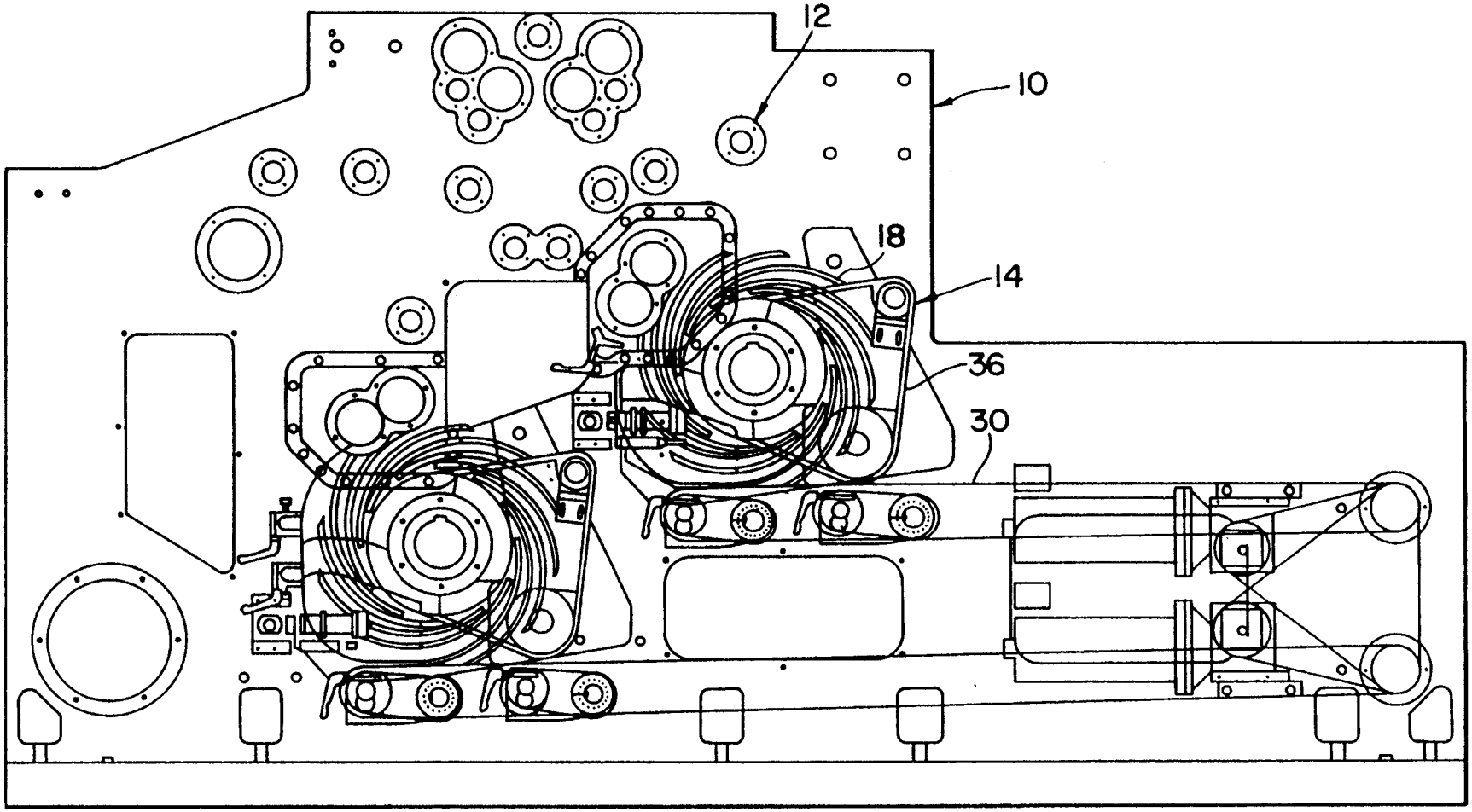
FIG. 1 is a side elevational view of a folder and a stripping device for use in a printing press.
Figure 2:
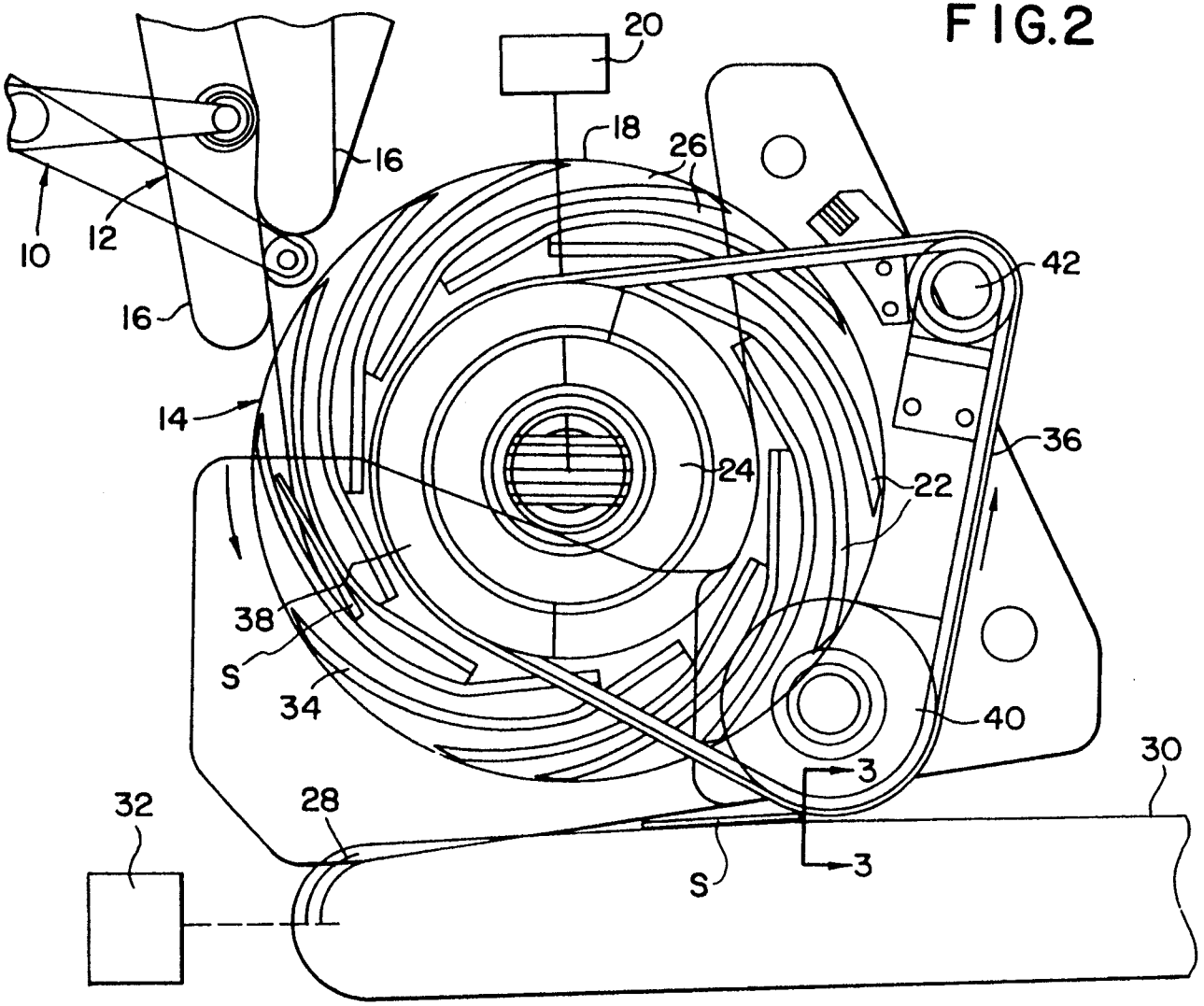
FIG. 2 is an enlarged side elevational view of the stripping device of FIG. 1.

Referring now to FIGS. 1 and 2, there is shown a printing press generally designated 10 having a folder generally designated 12 for folding signatures S, and which passes the signatures S to a stripping device generally designated 14. As shown, the folder 12 has one or more driven endless belts 16 for passing the folded signatures S to the stripping device 14.

As best shown in FIG. 2, the stripping device 14 has at least one rotatable fly 18 rotatably driven by a suitable motor 20. The fly 18 has a plurality of arcuate arms 22 disposed peripherally around a central hub 24, with the arms 22 being directed outwardly from the hub 24, and with the arms 22 defining a plurality of open pockets 26 disposed peripherally around the hub 24. The motor 20 drives the hub 24 in order to rotate the pockets 26 around the movable fly 18, with separate pockets 26 sequentially receiving separate folded signatures S from the belts 16 of the folder 12.

The device 14 has an endless conveyor belt 30 which is mounted on rotatable pulleys 30, with at least one of the pulleys 28 being driven by a suitable motor 32 in order to move the conveyor belt 30 relative to the fly 18. As shown, the conveyor belt 30 is located adjacent an exit portion 34 of the fly 18 in a position to receive the signatures S from the pockets 26 of the fly 18 for delivery of the signatures S in a stacked configuration onto the conveyor belt 30. During this time, the stripping device 14 removes the signatures S from the pockets 26 of the fly 18 onto the conveyor belt 30.

Figure 3:
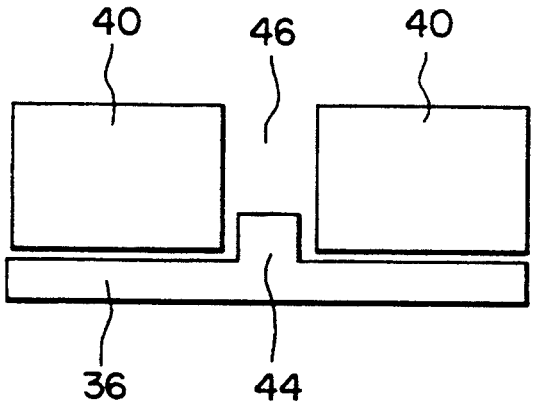
FIG. 3 is a sectional view taken substantially as indicated along the line 3—3 of FIG. 2.

The stripping device 14 has an endless stripping or stripper belt 36 passing around a plurality of rotatable pulleys 38, 40, and 42. The pulley 38 is free wheeling around the hub 24 of the fly 18, such the pulley 38 may freely rotate on the hub 24. As shown in FIG. 3, the stripping belt 36 has an inner central flange 44 which is received in a lateral central groove 46 in the pulleys 38, 40, and 42 in order to stabilize the stripper belt 36 on the pulleys.

With reference to FIG. 2, the stripper belt 36 passes around the pulley 40 at a location such that the stripper belt 36 engages the conveyor belt 30 in a configuration such that the conveyor belt 30 drives the stripper belt 36 at approximately the same speed as the conveyor belt 30, which speed is less than the rotational speed of the fly 18.

The stripper belt 36 passes around the hub 24 and pulley 38 in the pockets 26 of the fly 18. As shown, the stripper belt 36 is disposed at an acute angle in the pockets 26 of the fly 18 in the exit portion 34 of the fly 18, and at least a portion of the stripper belt 36 is located adjacent an outer end portion of the pockets 26 in the exit portion 34 of the fly 18. The moving stripper belt 36 thus engages against the inner edge of the signatures S in the pockets 26 in the exit portion 34 of the fly 18 in order to push the signatures S out of the pockets 26 in a shingled configuration onto the conveyor belt 30 for delivery of the signatures S to a delivery location adjacent the other end of the conveyor belt 30.

The conveyor belt 30 and striper belt 36 move at a speed which reduces the relative velocity between the rotating fly 18 and the stripper belt 36 with relationship to a stationary configuration of the stripper belt 36. Thus, the stripper belt 36 gently pushes the signatures from the pockets 26 progressively along the exit portion 34 of the fly 18, with the signatures S being delivered from the fly 18 onto the conveyor belt 30.

In this manner, the stripping device 14 releases the signatures S from the fly 18 without denting or marking the leading edge of the signatures which need not be a folded edge. In the past, stationary stripping devices could only be used on a folded edge of the signatures, and not the cut edge of the signatures, else the signatures would become marked by the stripping device 14 on the cut edge at relatively high speeds of the press, such as 2,000–3,000 ft./min. In the event that the marking is large enough such that a portion of the mark remains after trimming the signatures, then the printed and folded signatures S are rendered worthless, and must be discarded, causing inconvenience and waste by the press. The stripping device 14 may be even used on the cut edge of the signatures S without marking, thus greatly improving the handling of the signatures, and eliminating significant inconvenience and waste during operation of the press 10.

Figure 4:
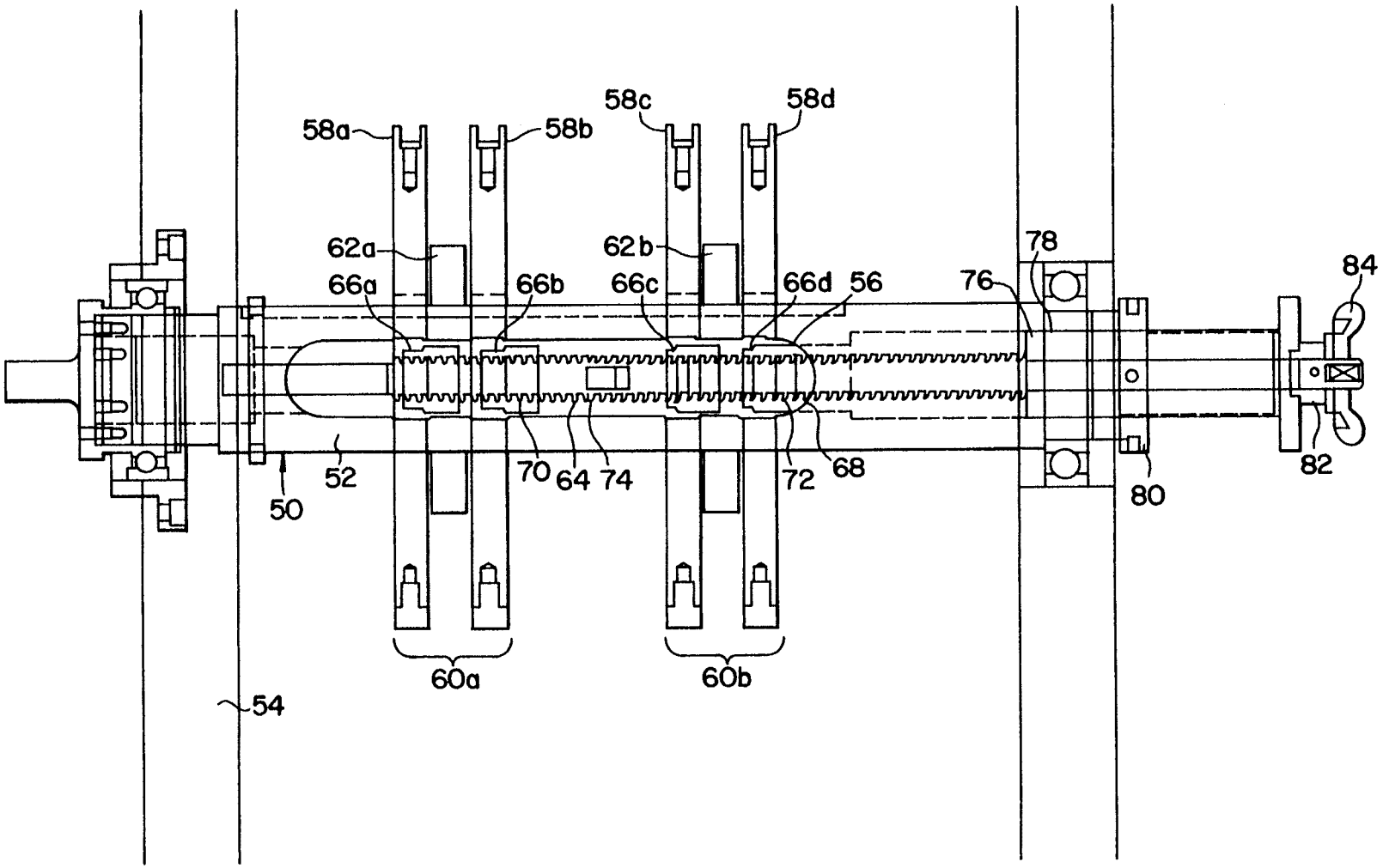
FIG. 4 is a plan view, taken partly in section, of a fly adjustment device of the present invention.

Referring now to FIG. 4, there is shown a device generally designated 50 for delivering the signatures S for the printing press 10. The device 50 has a hollow shaft 52 retained by a frame 54 of the delivery device 50. The shaft 52 has an elongated opening or cut-out 56 extending along the shaft 52. The device 50 has a plurality of flies 58*a*, 58*b*, 58*c*, and 58*d*, as previously described, slidably mounted on the outer surface of the shaft 52, with the group of flies 58*a–d* being separated into a pair of fly sets 60*a* and 60*b*, with one set 60*a* containing a pair of flies 58*a* and *b*, and the second set 60*b* containing the other pair of flies 58*c* and *d*. The device 50 also has a pair of stripper devices 62*a* and 62*b*, as previously described, disposed between adjacent pairs of flies 58*a–d*. As shown, the stripper device 62*a* is located between the flies 58*a* and *b* in the first set 60*a*, and the second stripper device 62*b* is located between the flies 58*c* and *d* in the second set 60*b*. Thus, the set 60*a* comprises the contiguous arrangement of the fly 58*a*, the stripper device 62*a*, and the fly 58*b*, while the second set 60*b* comprises the fly 58*c*, the contiguous second stripper device 62*b*, and the fly 58*d*. The flies 58*a–d* and respective stripper devices 62*a* and *b* are maintained together in the sets 60*a* and *b* during operation of the device 50.

The device 50 has an elongated threaded screw 64 rotatably retained in the hollow shaft 52 in a configuration with the screw 64 facing the opening 56. The device 50 has a plurality of threaded blocks 66*a*, 66*b*, 66*c*, and 66*d* positioned on the threaded screw 64, such that the blocks 66*a–d* may move along the screw 64 in opposite directions, as will be seen below. The block 66*a* is secured to the hub of the first fly 58*a*, the block 66*b* is secured to the hub of the second fly 58*b*, the block 66*c* is secured to the hub of the third fly 58*c*, and the block 66*d* is secured to the hub of the fourth fly 58*d*, such that lateral movement of the blocks 66*a–d* along the screw 64 causes corresponding lateral movement of the associated flies 58*a–d* along the screw 64. As shown, the screw 64 has an elongated first portion 72 having annular first threads 68 formed in a first angular direction (left or right hand threads) around the screw 64, and an elongated second portion 74 having annular second threads 70 formed in an opposite second angular direction (opposite right or left hand threads) around the screw 64, such that the set of flies 60*a* or *b* located on the first portion 72 of the screw 64 causes linear movement of these flies along the screw 64 responsive to rotation of the screw 64 in a first rotational direction, and the set of flies 60*a* or *b* located on the second portion 74 of the screw 64 causes linear movement of these other flies along the screw 64 in a second opposite linear direction responsive to rotation of the screw 64 in a second opposite rotational direction with each set of flies 60*a* and *b* and associated stripper devices 62*a* and *b* moving along the screw 64 in unison.

As shown, the device 50 has a threaded annular block 76 retained in a cylindrical threaded bore 78, and a first handwheel 80 is connected to the block 76. When the handwheel 80 is rotated by the operator of the press 10, then the rotation of the block 76 in the bore 78 in opposite rotational directions causes lateral movement of the screw 64 in opposite directions along the hollow shaft 52. Hence, rotation of the handwheel 80 in a first angular direction causes all the flies 58*a–d* to move in a first linear direction along the screw 64, while rotation of the handwheel 80 in a second opposite angular direction causes all the flies 58*a–d* to move in a second opposite linear direction along the shaft 52. During this time, the screw 64 is not rotated, and the separation between the sets of flies 60*a* and *b* remains the same. In this manner, all of the flies 58*a–d* may be adjusted in a group laterally in the delivery device 50 along the shaft 52 in order to change the relative locations of the entire group of flies 58*a–d* in order to accommodate incoming signatures which are located at different lateral locations in the delivery device 50.

As shown, the device 50 has an elongated rod 82 extending from one end of the screw 64 to a second handwheel 84. In the event that the second handwheel 84 is rotated in a first angular direction, the corresponding screw 64 is also rotated in the blocks 66*a–d*, causing separation of the two sets of flies 60*a* and *b* relative to each other, while rotation of the handwheel 84 in a second opposite angular direction causes contraction of the two sets 60*a* and *b* of the flies in relative to each other, depending upon which set of flies 60*a* and *b* is located on the first and second portions 72 or 74 of the screw 64 having oppositely directed threads, as previously described. Thus the sets 60 and b of the flies 58*a–d* and corresponding blocks 66*a–d* may either be moved toward each other, as shown in the drawing, or may be separated from each other depending upon the angular direction the second handwheel 84 is rotated by the operator. In this manner, the distance between the sets 60*a* and *b* of the flies 58*a–d* and associated stripping devices 62*a* and *b* may be modified to accommodate different lateral widths of the incoming folded signatures to the delivery device 50. Of course, both the first handwheel 80 may be used to adjust the lateral position of the fly sets 60*a* and *b* at the same time the second handwheel 84 may be used to modify the distance between the fly sets 60*a* and *b* during a given adjustment of the device 50.

In this manner, the delivery device 50 may be modified in a simplified manner in order to accommodate the delivery of signatures having both differing widths and lateral locations, either together or separately in the delivery device 50.

The foregoing detailed description has been given for clearness of understanding only, and no unnecessary limitations should be understood therefrom, as modifications will be obvious to those skilled in the art.

What is claimed is:

1. A device for delivering signatures for a printing press, comprising:

a delivery device having a plurality of sets of flies, with the flies each having a plurality of open pockets disposed around the flies;

means for stripping signatures from the pockets disposed between a pair of adjacent flies in each set of flies; and means for laterally modifying the distance between different sets of flies and accompanying stripping means in each of the sets.

2. The device of claim 1 in which each set of flies has a pair of opposed flies, and a stripping device disposed between the pair of flies in each of the sets.

3. The device of claim 1 including means for adjusting each of the sets of flies and associated stripping means in unison laterally across the delivery device.

4. The device of claim 1 in which each set of flies has a pair of opposed flies, and a stripping device disposed between the pair of flies in each of the sets.

5. The device of claim 1 in which each set of flies has a pair of opposed flies, and a stripping device disposed between the pair of flies in each of the sets.

6. The device of claim 1 including an elongated screw, and in which the modifying means and adjusting means are supported on the screw.

7. A device for delivering signatures for a printing press, comprising:

a delivery device having a plurality of sets of flies, with the flies each having a plurality of open pockets disposed around the flies;

means for stripping signatures from the pockets disposed between a pair of adjacent flies in each set of flies; and means for laterally adjusting the sets of flies and stripping means in unison across the delivery device.

8. The device of claim 7 including means for modifying the lateral distance between different adjacent sets of flies and associated stripping means.

9. A device for delivering signatures for a printing press, comprising:

a delivery device having a plurality of sets of flies, with the flies each having a plurality of open pockets disposed around the flies;

means for stripping signatures from the pockets disposed between a pair of adjacent flies in each set of flies;

means for laterally modifying the distance between different sets of flies and associated stripping means in each of the sets; and means for laterally adjusting all the sets of flies in unison across the delivery device.

* * * * *